US009409224B2

(12) United States Patent
Roeterdink

(10) Patent No.: US 9,409,224 B2
(45) Date of Patent: Aug. 9, 2016

(54) METHOD AND APPARATUS FOR RADIALLY EXPANDING A CONTAINER BODY, SUCH RADIALLY EXPANDED CONTAINER BODY AND A CONTAINER COMPRISING SUCH CONTAINER BODY

(75) Inventor: Johan Willem Roeterdink, Epse (NL)

(73) Assignee: Impress Group B.V., Deventer (NL)

( * ) Notice: Subject to any disclaimer, the term of this patent is extended or adjusted under 35 U.S.C. 154(b) by 1426 days.

(21) Appl. No.: 12/936,803

(22) PCT Filed: Apr. 21, 2009

(86) PCT No.: PCT/EP2009/002988

§ 371 (c)(1),
(2), (4) Date: Aug. 2, 2011

(87) PCT Pub. No.: WO2009/130034

PCT Pub. Date: Oct. 29, 2009

(65) Prior Publication Data

US 2011/0277528 A1 Nov. 17, 2011

(30) Foreign Application Priority Data

Apr. 22, 2008 (EP) ..... 08007747

(51) Int. Cl.

| | |
|---|---|
| ***B21D 39/20*** | (2006.01) |
| ***B21D 22/02*** | (2006.01) |
| ***B21D 51/26*** | (2006.01) |

(52) U.S. Cl.

CPC ..... *B21D 39/20* (2013.01); *B21D 22/025* (2013.01); *B21D 51/2676* (2013.01)

(58) Field of Classification Search

CPC ..... B21D 39/08; B21D 39/20; B21D 41/026; B21D 41/028; B21D 51/263; B21D 51/2669

USPC ..... 72/347–349, 352, 367.1, 368, 370.01, 72/370.02, 370.06, 370.1, 370.11, 370.23, 72/370.24, 370.08, 715

See application file for complete search history.

(56) References Cited

U.S. PATENT DOCUMENTS

| | | | | |
|---|---|---|---|---|
| 4,034,591 | A | 7/1977 | Rothenberger | |
| 5,101,653 | A * | 4/1992 | Hermes et al. | 72/393 |
| 5,836,197 | A | 11/1998 | McKee et al. | |
| 6,182,487 | B1 * | 2/2001 | Komiya et al. | 72/62 |
| 6,442,991 | B1 | 9/2002 | Rojek | |

FOREIGN PATENT DOCUMENTS

| | | | |
|---|---|---|---|
| DE | 10040173 | A1 | 5/2001 |
| FR | 2300638 | | 9/1976 |
| GB | 509188 | | 7/1939 |
| JP | 07032073 | A | 3/1995 |
| JP | 2000301249 | A | 10/2000 |

OTHER PUBLICATIONS

Computer Translation of Odajima JP 2000-301249.*

* cited by examiner

*Primary Examiner* — Alexander P Taousakis
*Assistant Examiner* — Pradeep C Battula
(74) *Attorney, Agent, or Firm* — The Webb Law Firm

(57) ABSTRACT

The invention relates to a method for radially expanding a container body, including the steps of: i) providing a cylindrical container body having a longitudinal weld seam; ii) providing the container body at least one end with a flange; iii) clamping the container body circumferentially at the flange in a suspended state; and iv) radially expanding the suspended and clamped body from the clamped body end towards the suspended body end, to an apparatus therefore and to the container body and container.

8 Claims, 5 Drawing Sheets

METHOD AND APPARATUS FOR RADIALLY EXPANDING A CONTAINER BODY, SUCH RADIALLY EXPANDED CONTAINER BODY AND A CONTAINER COMPRISING SUCH CONTAINER BODY

CROSS-REFERENCE TO RELATED APPLICATIONS

This application is the United States national phase of International Application No. PCT/EP2009/002988 filed Apr. 21, 2009, which claims priority to European Patent Application No. EP 08007747.2 filed Apr. 22, 2008.

BACKGROUND OF THE INVENTION

1. Field of the Invention

The present invention relates to a method and apparatus for radially expanding a container body, to such radially expanded container body and to a container comprising such radially expanded container body.

2. Description of the Related Art

Presently, containers provided with a necked body portion are used for making containers, such as vacuum, pressurized or aerosol containers. Such containers comprise a container body having a necked portion to which necked portion is connected a top closure or cap. Such closure is generally residing within the cylindrical confinement of the container body. The other end of the container body is provided with a bottom end. For such containers having a different surface area at the bottom end and at the cap end, it is possible to use materials of different thickness. For instance, the bottom end has a diameter of about 65 mm and the cap end has a diameter of about 52 mm. At such bottom end the wall thickness may be about 0.18 mm. At the cap end, the cap might have a thickness of about 0.26-0.28 mm or thicker at larger diameters.

For such pressurized container having a necked portion it is traditional to produce the container body for such container by starting from a cylindrical container body produced by forming into a cylindrical shape a rectangular or square sheet of metal of which the abutting or overlapping longitudinal edges are welded together by a longitudinal weld seam.

Subsequently, this cylindrical container body having a longitudinal weld seam is subjected to radial expansion using punch means which are driven through one end of the cylindrical container body and urging radially outwardly the container body into a wider diameter while the punch means progressively are driven through the container body. During the radial expansion by driving the punch means through the cylindrical container body, the body is resting on a reaction table for resisting the driving forces of the punch means exerted on the inner surface of the container body.

The radially expanded container body produced with the traditional method as described above, shows various defects. First, there is a wavy structure over the longitudinal weld seam and over other areas in the outer surface of the cylindrical container body. Second, the end of the container body through which the punch means are driven for radially expanding the container body shows an irregular edge, predominately irregular when this end was provided with a flange intended for connection to the container bottom. Such irregular edge or flange edge at this container end is referred to as earring. This irregular edge may give rise to problems when connecting the bottom end to the container, preferably via the flange of the container body. The irregularities may amount from 0.1 to about 0.5 mm. Third, over the height of the cylindrical container body subjected to radial expansion the wall thickness is not substantially constant and tends to increase onward from the container body end where the radial expansion started.

The irregularities at the container body edge may be removed by cutting resulting in the formation of a substantially regular container body edge. However, such cutting operations are cumbersome and cost raising.

SUMMARY OF THE INVENTION

The present invention has for its object to improve the method for radially expanding a container body and intends to avoid or minimize the above identified drawbacks.

Accordingly, the present invention provides a method for radially expanding a container body, comprising the steps of:

i) providing a cylindrical container body having a longitudinal weld seam;

ii) providing the container body at least one end with a flange;

iii) clamping the container body circumferentially at the flange in a suspended state; and iv) radially expanding the suspended and clamped body from the clamped body end towards the suspended body end.

The present invention is based on the insight, that when the cylindrical container body is suspended and does not contact during the radial expansion the reaction table substantially all the afore mentioned drawbacks are overcome. Presumably because when in the freely suspended state the radial expansion will not initiate or generate a counter force or stress as would occur when the container body would be supported by the reaction table. Accordingly, during radial expansion the metal forming the container body will move radially outwardly but also axially towards the freely suspended end of the container body allowing a compensation or neutralisation of the stresses during radial expansion and axial elongation up to near the yield point of the material.

Accordingly, the radially expanded container body will substantially not show a wavy structure along the longitudinal weld seam or in other radially expanded regions of the container body. Furthermore, the container body edge or flange edge will be substantially regular and devoid of earring, thus avoiding cutting operations or any interference in the operation of connecting the bottom to the radially expanded container body. Furthermore, it is surprisingly found that after radial expansion and during the withdrawal of the punch means, the punch means release more easily presumably because of a minimal stretch reduction by a value of about 0.2-0.4%. Accordingly, the use of oil for lubricating the inner surface of the container body during radial expansion may be avoided which is of major importance in relation to the subsequent use of the body container in a container comprising food, feed or beverage.

In addition, harder metal material for the container may be used, such as metal material having a high hardness up to DR8. This implies a further reduction of a rise for buckling or formation of a wavy structure. More importantly, this could result in a further reduction in the wall thickness of the cylindrical container body to be radially expanded and of the produced container body and ultimately the container. Finally, it appears that with the method according to the invention the stretch ratio is larger.

According to a preferred embodiment it is possible with the method according to the invention that the body is expanded by 10-40%, preferably 15-30%. The method according to the invention is in essence suitable for use of radially expanding any container body having a symmetrical cross section.

Although the invention is applicable to any dimension and diameter, as an example, the cylindrical container body has a diameter of 30-100 mm, preferably 40-80 mm.

For a reliable and smooth radial expansion operation and insertion of the punch means for the radial expansion, it is preferred that the body is provided with a tromped mouth over a part of the body height. Accordingly, it is possible to insert reliably and rapidly the means for radial expansion via this tromped mouth of the cylindrical container body.

Elegantly, because of a reduction in processing time, it is preferred that the tromped mouse is formed in the same operation when forming the container flange at least at the end where the radial expansion will start. Obviously, it is possible at the same time, afterwards or in advance to form the flanges or both flanges and in particular the flange for the bottom part.

According to a preferred embodiment the radial expansion of the cylindrical container body does not take place over its whole length but over a substantial part of the height of the cylindrical container body thereby forming a part of a reduced diameter which alternately could form the necked portion of the container. Obviously it is possible to further reduce the diameter of this necked portion by an additional necking operation. It goes without saying that within the concept of the invention the container body may be radially expanded over its total height.

The material of which the container body is made could be any type of metal but preferred is steel, such as iron steel and the like. If needed, coatings may be applied to the inner and outer surfaces of the cylindrical container body before or after the radial expansion. Afterwards is preferred because after the radial expansion the inner surface and preferably also the outer surface of the radially expanded cylindrical container body will have a substantially circular and even inner and outer surface.

The present invention further provides an apparatus for making a radially expanded body, comprising:

i) means for circumferentially clamping a flange of a cylindrical container body such that the clamped body is freely suspended during radial expansion;

ii) punch means provided with a circumferential expansion surface; and iii) means for driving the punch means through the clamped end of the suspended container body, over at least part of the container body height.

Important is that the means for circumferentially clamping a flange of the cylindrical container body to be radially expanded are positioned at such height that the other end of the cylindrical container body does not contact a reaction table during substantially the whole radially expanding operation.

Preferably, the circumferential expansion surface is provided with means for radially adjusting the diameter of the circumferential expansion surface. Accordingly, it is possible to withdraw the punch means after radial expansion over the desired height of the cylindrical container body at lowest forces because the punch means are no longer in contact with the inner surface of the cylindrical container body after radial expansion. It is further preferred that the driving means reciprocally move the punch means through the container body to be radially expanded. Accordingly, the operation of radial expansion and withdrawal thereafter of the punch means in a even and smooth operation. Accordingly, it is preferred that the radial adjusting means adjust the diameter of the circumferential expansion surface at a smaller diameter when after radial expansion the punch means are removed from the radially expanded container body.

As indicated here and before it is preferred to radially expand a cylindrical container body being provided with a tromped mouth. Accordingly, it is preferred that the apparatus according to the invention comprises means for providing the cylindrical container body with a flange and/or a tromped mouth.

Another aspect of the present invention relates to a radially expanded container body obtainable with the afore mentioned method or by the application of the afore mentioned apparatus. This radially expanded container body exhibits the afore mentioned improvements over the prior art radially expanded cylindrical container bodies.

Finally, the present invention also relates to a container comprising such radially expanded container body and have been provided at one end with a bottom and/or at the other end with a cap for closing the container, for instance a vacuum container. Such containers are very well suitable for instance aerosol containers and whipped cream containers.

BRIEF DESCRIPTION OF THE DRAWINGS

Mentioned and other features of the method apparatus container body and container according to the invention will be further elucidated by reference to embodiments of the present invention which are given for information purposes and not intended to limit any extent the present invention. In this respect reference will be made to the annexed figures in which FIGS. 1-3 schematically show the formation of a cylindrical container body provided with a tromped mouth.

DETAILED DESCRIPTION OF THE INVENTION

Figure 1:
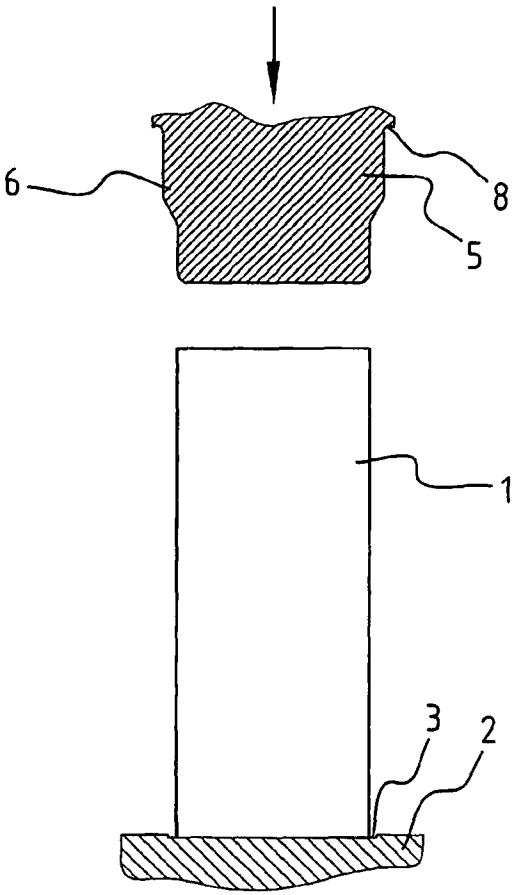

FIG. 1 shows a cylindrical container body 1 resting on a reaction table 2. The reaction table 2 is provided with a groove 3 in which the body 1 will be provided with a flange 4 during the operation shown in FIG. 2. Shown is further a punch tool 5 provided with an outer surface structure 6 for forming a tromped mouth 7 (see FIG. 5). The punch tool 5 is further provided with a growl structure 8 for forming a flange 9 in the container body 10.

Figure 2:
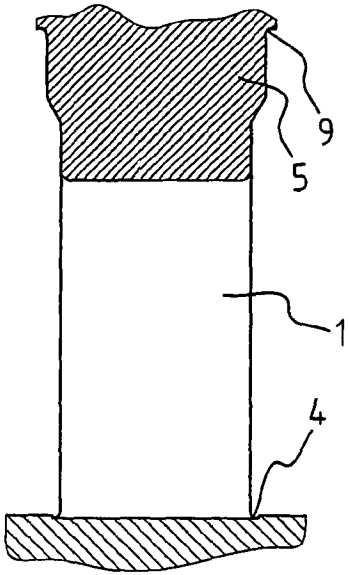

As shown in FIG. 2, the punch tool 5 is pressed into the container body 1 thereby forming the tromped mouth 7, the flange 4 and the flange 9.

Figure 3:
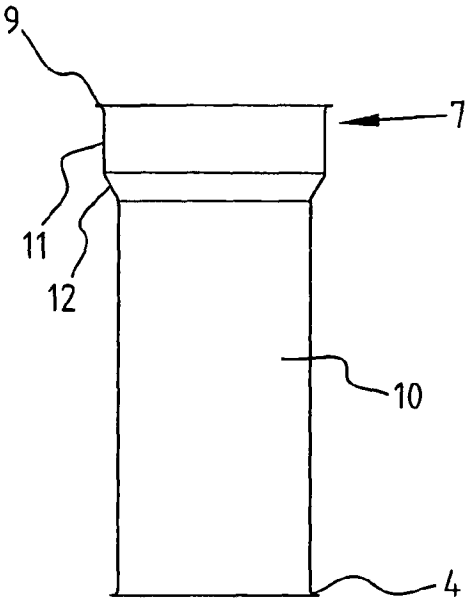

As shown in FIG. 3, the tromped mouth comprises adjacent to the flange 9 a radially expanded section 11 and a transition section 12.

Figure 6:
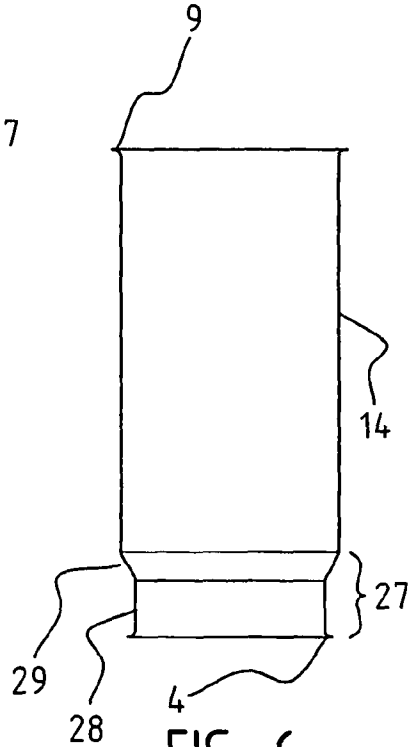
FIGS. 4-6 show the formation of a radially expanded container body according to a first embodiments.
Figure 5:
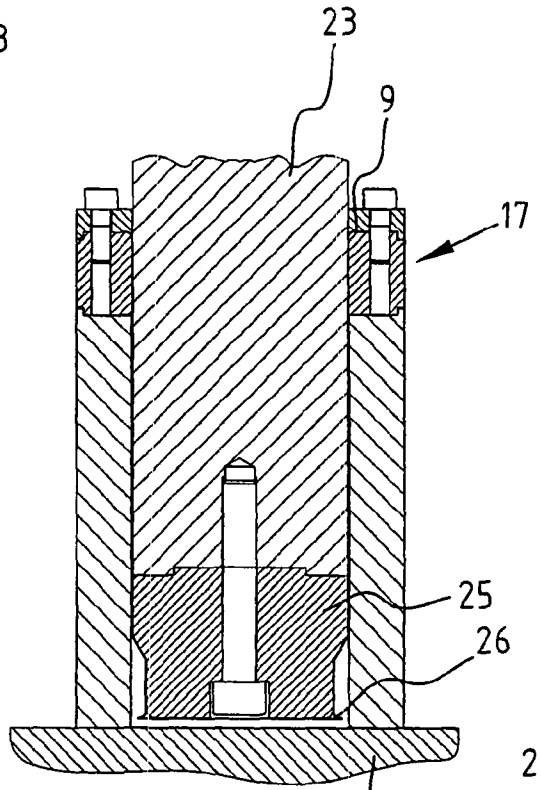
Figure 4:
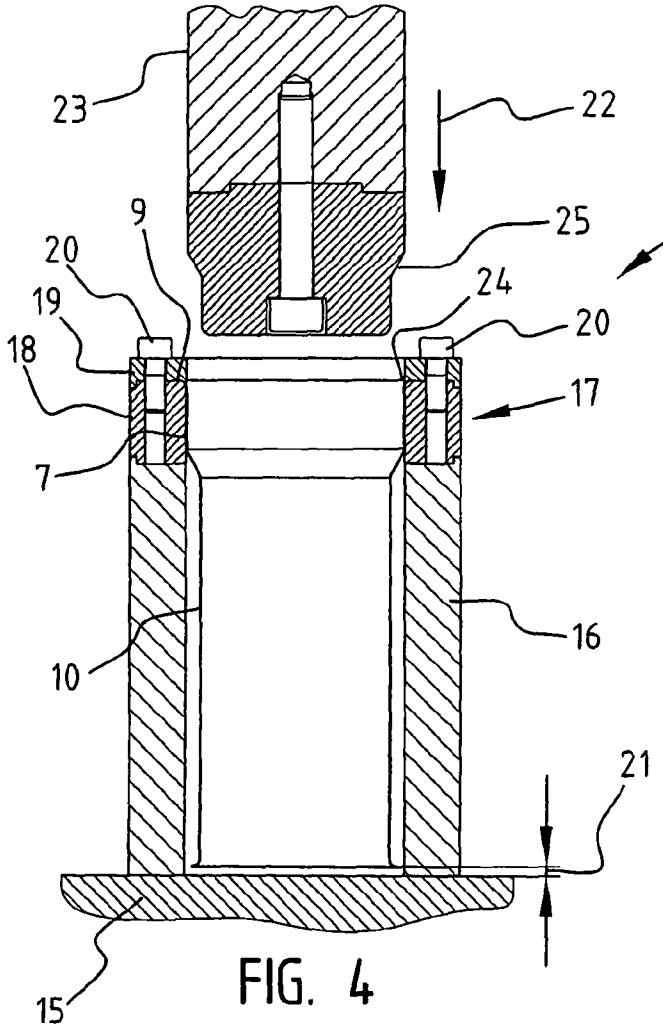

As shown in the FIGS. 4-6, this cylindrical body 10 provided with the tromped mouth 7 is mounted in the apparatus 13 for making the radially expanded body 14 according to the invention. The apparatus 13 comprises a support 15 supporting a frame 16 carrying means 17 for clamping the flange 9 between a lower clamping ring 18 and a upper clamping ring 19 pressed onto one another by clamping bolts 20. The clamping means 17 are arranged at such level above the support 15 that the body 10 clamped by the clamping means will be in a suspended state and at a distance 21 above the support 15 throughout the whole radial expansion operation (see FIG. 5).

Following the arrow 22 a punch 23 for radially expanding the container body 10 is the driven through the clamped end 24 of the suspended container body 10. The punch 23 carries a punch tool 25 having in outer structure corresponding to the intended radially expanded form of the container obtained when the punch 23 is lowered to such extent that the tool 25 approaches the other end 26 of the now radially expanded container body 14 still clamped at its flange 9 in the clamping means 17. By a reciprocal movement the punch means are removed out of the radially expanded container body 14. Due to the radial expansion in the free suspended stage the punch 23 is relatively easy removable out of the container body 14, even without the use of an oil.

FIG. 6 shows the container 14 according to the invention comprising a necked portion 27 comprising the necked section 28 and the transition section 29. It is noted that this necked portion may be further necked if required or widened if required. Still at the flanges 4 and 9 the container body 14 may be connect to a non-shown bottom and cap, respectively.

The FIGS. 7-14 show another apparatus 30 according to the invention for radially expanding a container body. Again, a cylindrical container body 10 is clamped with its flange 9 in the clamping rings 18 and 19 of the clamping means 17.

A punch means 31 carry a punch nose 32 connected via a bolt 33 to the punch body 34. The punch nose 32 is provided with a shaft 35 around which are arranged radially movable wedge ring parts 37 connected at a wedge surface 43 with wedge ring parts 38. The wedge ring parts 38 lay against the inner surface of a punch tool 39 which forms with the surface of the punch nose 32 a continuous but gradually in diameter increasing punch.

Figure 8:
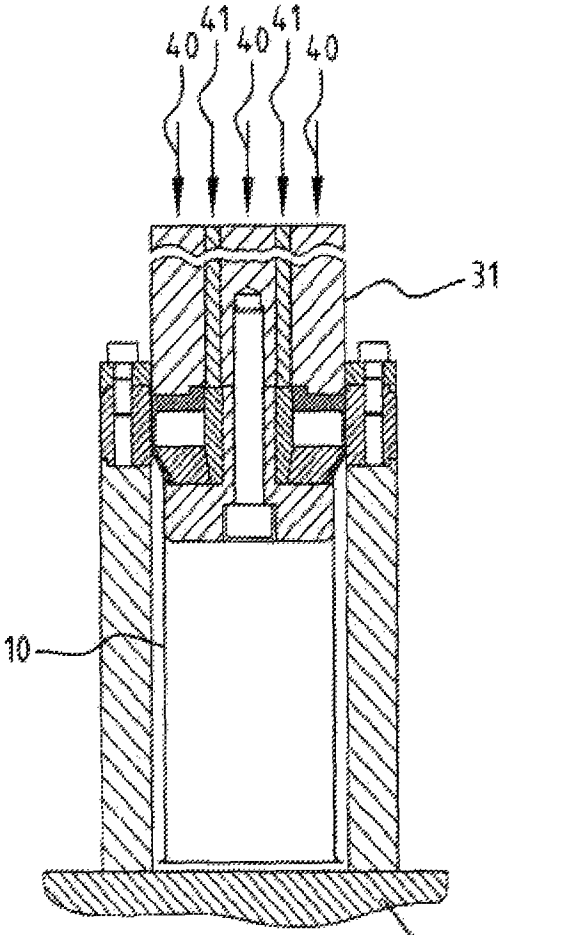
FIGS. 7-14 show a method and apparatus for radially expanding a container body according to a second embodiment.
Figure 7:
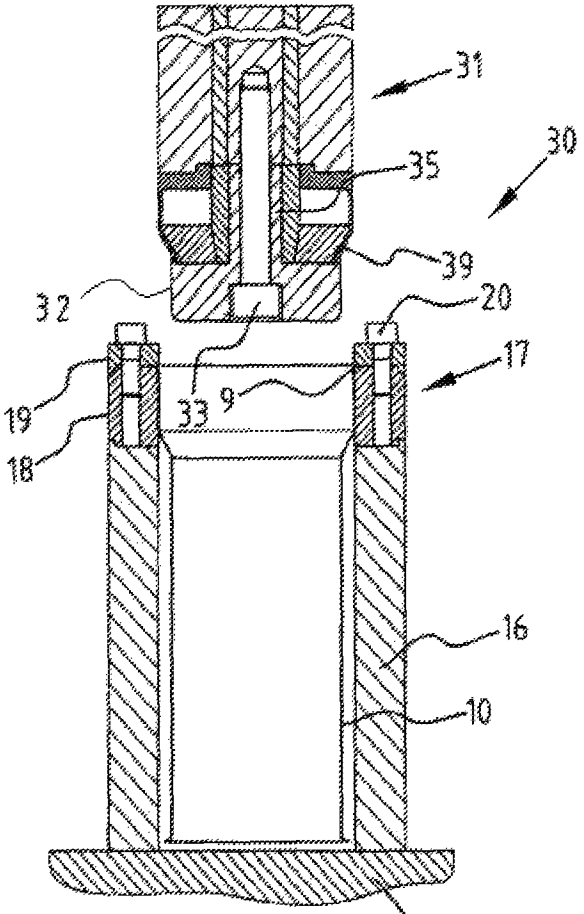

As shown in FIG. 8 the punch means 31 are driven downwardly into the tromped mouth 7 of the container body 10 while exerting force according to the arrows 40 and 41. According to the arrows 41 via the transition elements 42 force is exerted on the wedge ring parts 37 which by the wedge surfaces 43, 44 urged the wedge ring parts 38 outwardly against the punch tool 39 which radially expand the container body 10.

Figure 10:
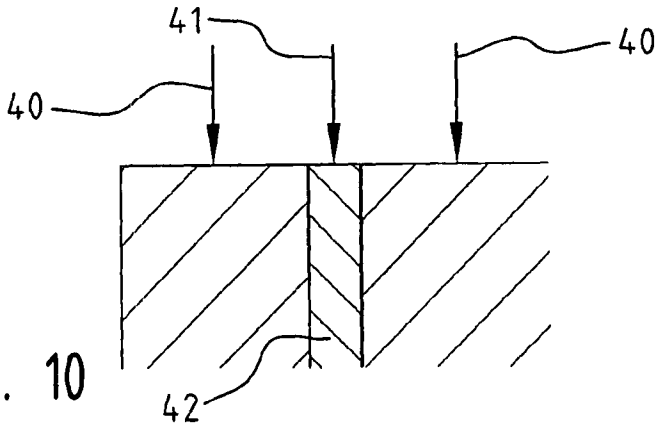
Figure 9:
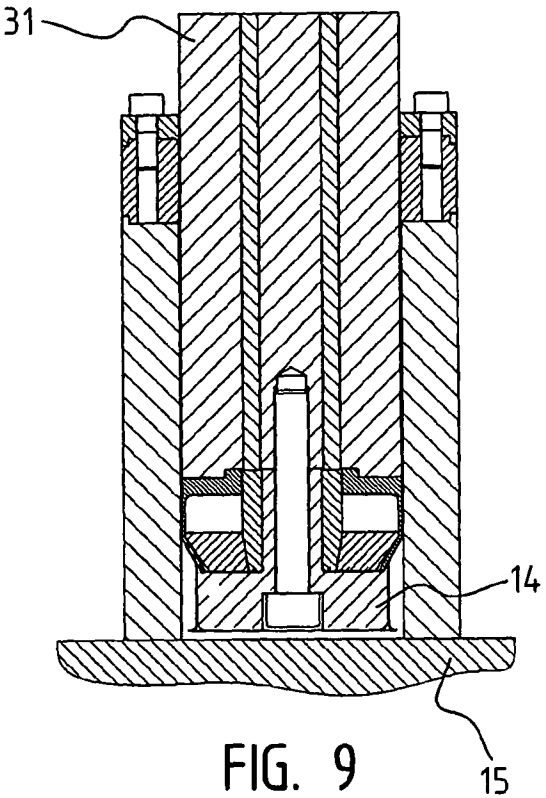
Figure 13:
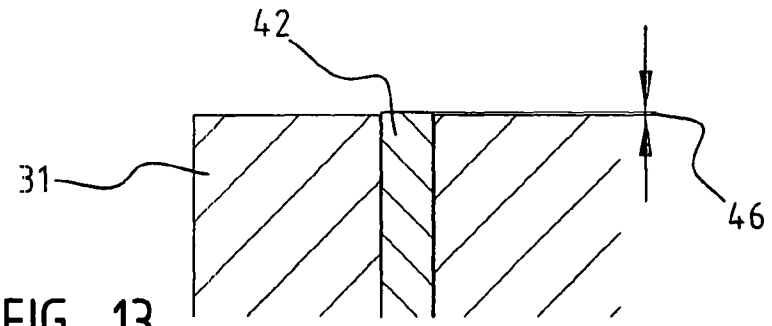
Figure 14:
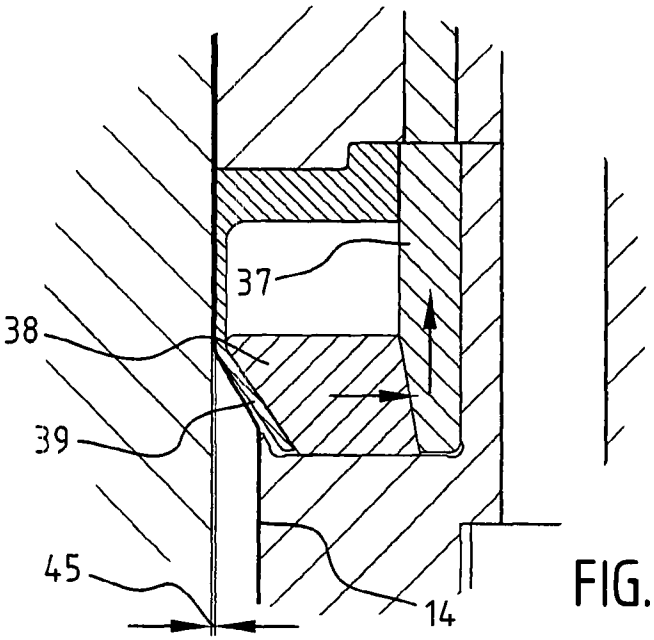

As described in relation to FIG. 10, the punch means 31 are driven to the extent as shown in FIG. 9 with still the now radially expanded container body 14 freely suspending from the support 15.

Figure 11:
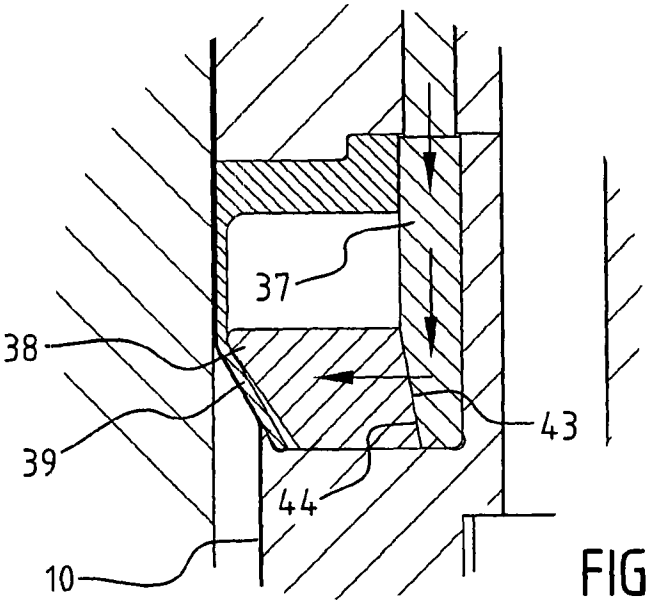
Figure 12:
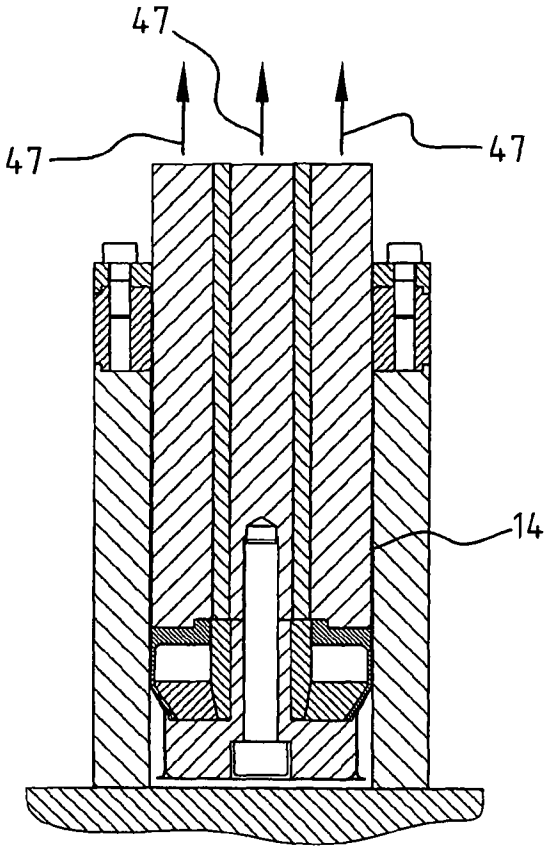

Before withdrawing the punch means 31 from the position as shown in FIG. 12 the pressure according to arrow 41 in FIGS. 10 and 11 is released so that under the resilient property of the press tool 39, the wedge ring parts 38 may move inwardly because the wedge ring part 37 is allowed to move upwardly. This results in a clearance 45 between the radially expanded container body 14 and the punch means 31. Proportionally the transition element 42 has moved upwardly over a distance 46 (see FIG. 14).

With a clearance 45 in between the radially expanded container body 14 and the punch means 31, the punch means following the arrows 47 may now be moved upwardly with substantially no friction resistance with the radially expanded container body 14. Accordingly, it is no longer required to use oil for radially expanding and reciprocally removing the punch means out of the radially expanded container body.

The radial expanded container body according to the invention and a container comprising such radially expanded container shows in particular at the longitudinal weld seam substantially no wavy structure and the flange used for clamping is substantially regular and does not require any cutting operations and could be used as such for connection to a bottom end. Finally, the thickness of the walls of the radially expanded container body is substantially constant and for example a container body starting from a diameter of about 52 mm and with a wall thickness of about 0.18 mm will show over the necked portion and over the radially expanded portion a thickness varying between about 0.165 to about 0.175 mm.

The invention claimed is:

1. A method for radially expanding a container body, comprising the steps of:

i) providing a cylindrical container body having a longitudinal weld seam;

ii) providing the container body at at least one end with a flange to create a flanged container body;

iii) clamping the flanged container body circumferentially at the flange in a suspended state to provide a suspended and clamped body; and (iv) radially expanding the suspended and clamped body from a clamped body end towards a suspended body end to provide a radially expanded body, wherein the radial expansion is carried out using a radial adjusting means for radially adjusting a diameter of a radially adjustable, continuous circumferential expansion surface of a resilient punch tool by acting on an inner surface of the resilient punch tool such that an exterior surface of the radially adjustable, continuous circumferential expansion surface of the resilient punch tool is in continuous contact with an inner surface of the container.

2. The method as claimed in claim 1, wherein the body is expanded by 10-40%.

3. The method as claimed in claim 2, wherein the body is expanded by 15-30%.

4. The method as claimed in claim 1, wherein the cylindrical container body has a diameter of 30-100 mm.

5. The method as claimed in claim 4, wherein the cylindrical container body has a diameter of 40-80 mm.

6. The method according to claim 1, wherein the body is provided with a tromped mouth over a part of the body height.

7. The method according to claim 6, wherein the tromped mouth is formed when forming the container body flange.

8. The method according to claim 1, wherein the body is radially expanded over a substantial part of the body height leaving a necked body end.

* * * * *